US007921615B2

(12) United States Patent
Picchio

(10) Patent No.: US 7,921,615 B2
(45) Date of Patent: Apr. 12, 2011

(54) IRON SHEET PANEL WITH HORIZONTAL GROOVE FOR INTERIOR SPACE PARTITIONING

(75) Inventor: Cesare Picchio, Vedano Al Lambro (IT)

(73) Assignee: Unifor S.p.A., Turate (Como) (IT)

( * ) Notice: Subject to any disclaimer, the term of this patent is extended or adjusted under 35 U.S.C. 154(b) by 595 days.

(21) Appl. No.: 11/970,601

(22) Filed: Jan. 8, 2008

(65) Prior Publication Data

US 2008/0202039 A1 Aug. 28, 2008

(30) Foreign Application Priority Data

Jan. 8, 2007 (CA) ..... 2,573,197

(51) Int. Cl.
*E04B 2/74* (2006.01)
*E04H 3/10* (2006.01)

(52) U.S. Cl. ..... 52/238.1; 52/239; 211/94.01; 211/162

(58) Field of Classification Search ..... 52/238.1, 52/239, 481.2, 169.13, 651.01, 651.09; 211/94.01, 211/162

See application file for complete search history.

(56) References Cited

U.S. PATENT DOCUMENTS

| | | | | | |
|---|---|---|---|---|---|
| 3,352,428 | A * | 11/1967 | Sak et al. | ..... | 211/106.01 |
| 4,750,624 | A * | 6/1988 | Baron | ..... | 211/87.01 |
| 4,809,940 | A * | 3/1989 | Trestyn | ..... | 248/220.22 |
| 5,341,615 | A * | 8/1994 | Hodges et al. | ..... | 52/220.7 |
| 5,582,116 | A * | 12/1996 | Spimpolo | ..... | 108/108 |
| 6,050,426 | A * | 4/2000 | Leurdijk | ..... | 211/94.01 |
| 6,199,706 | B1 * | 3/2001 | Shea | ..... | 211/87.01 |
| 6,561,474 | B1 * | 5/2003 | Walter et al. | ..... | 248/220.22 |
| 6,601,349 | B1 * | 8/2003 | Corden | ..... | 52/36.5 |
| 6,631,813 | B1 * | 10/2003 | Walter et al. | ..... | 211/94.01 |
| 6,837,384 | B2 * | 1/2005 | Secondino | ..... | 211/87.01 |
| 6,929,131 | B1 * | 8/2005 | Landi | ..... | 211/87.01 |

* cited by examiner

*Primary Examiner* — Phi Dieu Tran A
(74) *Attorney, Agent, or Firm* — Shoemaker and Mattare

(57) ABSTRACT

An improved panel is disclosed. The panel is of the type for use with a bracket and which, in use: forms a wall surface as part of an assembly for partitioning or dividing a space; defines a horizontal groove; and is adapted to releasably, securely, receive, via the horizontal groove, said bracket. The improvement comprises a metal sheet and a metal bolster. The metal sheet has a front and a rear face, the front face defining said wall surface in use and said sheet defining a horizontal slot in use. The metal bolster is secured to the rear face of said metal sheet to define, in combination with the metal sheet, said horizontal groove.

16 Claims, 5 Drawing Sheets

IRON SHEET PANEL WITH HORIZONTAL GROOVE FOR INTERIOR SPACE PARTITIONING

CROSS REFERENCE TO RELATED APPLICATIONS

This non-provisional application claims the benefit of Canadian Application No. 2573197, entitled "Sheet Panel with Horizontal Groove for Interior Space Partitioning," filed on Jan. 8, 2007, the entire disclosure of which is incorporated herein by reference, to the extent that it is not conflicting with the present disclosure.

FIELD OF THE INVENTION

The invention relates to the field of interior space partitioning.

BACKGROUND OF THE INVENTION

It is commonplace to partition interior spaces through the utilization of standard components which are adapted to interfit with one another to permit the construction of room partitions/dividers customized to meet the particular requirements of any given application. Often, such systems include structures which form skeletons or frameworks of walls which are completed through the use of panels which are secured/suspended from the frameworks to form the wall surfaces. Sometimes, it is desirable to suspend cupboards or the like from the walls, and it is known to do so by providing the panels with horizontal grooves which securely receive brackets from which cupboards and the like can be suspended. One known system of this latter type comprises an extruded profile in which is defined an undercut shape for receiving a hanger bracket, the profile being disposed in the horizontal junction between two panels. FIG. 4 shows an aluminum profile of this prior art type inserted between two wood panels, and also shows an exemplary hanger bracket securely, releasably received, via by undercut, by the panel/extrusion combination. FIG. 5 shows the bracket apart from the undercut, for clarity, and persons of ordinary skill in the art will recognize that removal of the bracket from the FIG. 4 position is easily effected by pivoting the lower end of the bracket away from the panels, to draw the hooked portion of the extrusion out of the undercut.

SUMMARY OF THE INVENTION

An improved panel forms one aspect of the invention. The panel is of the type for use with a bracket and which, in use: forms a wall surface as part of an assembly for partitioning or dividing a space; defines a horizontal groove; and is adapted to releasably, securely, receive, via the horizontal groove, said bracket. The improvement comprises a metal sheet and a metal bolster. The metal sheet has a front and a rear face, the front face defining said wall surface in use and said sheet defining a horizontal slot in use. The metal bolster is secured to the rear face of said metal sheet to define, in combination with the metal sheet, said horizontal groove.

A system forms another aspect of the invention. The system is for forming part of a wall surface of an assembly for partitioning or dividing a space and for suspending a cupboard from said wall surface. The system comprises a panel and a hook. The panel includes a metal sheet and a metal bolster. The metal sheet has a front and a rear face, the front face defining said part of said wall surface in use and said sheet defining a horizontal slot in use. The metal bolster is secured to the rear face of said metal sheet to define, in combination with the metal sheet, said horizontal groove. The bracket is adapted to be releasably, securely, received, via the horizontal groove, by said panel, and to have secured thereto said cupboard.

Panels constructed according to the foregoing are relatively inexpensive to manufacture, provide relatively high load capacity and provide enhanced flexibility over the prior art in terms of locating the bracket. Other advantages, features and characteristics of the present invention, as well as methods of operation and functions of the related elements of the structure, and the combination of parts and economies of manufacture, will become apparent upon consideration of the following detailed description and the appended claims with reference to the accompanying drawings, the latter being briefly described hereinafter.

DETAILED DESCRIPTION

Figure 1:
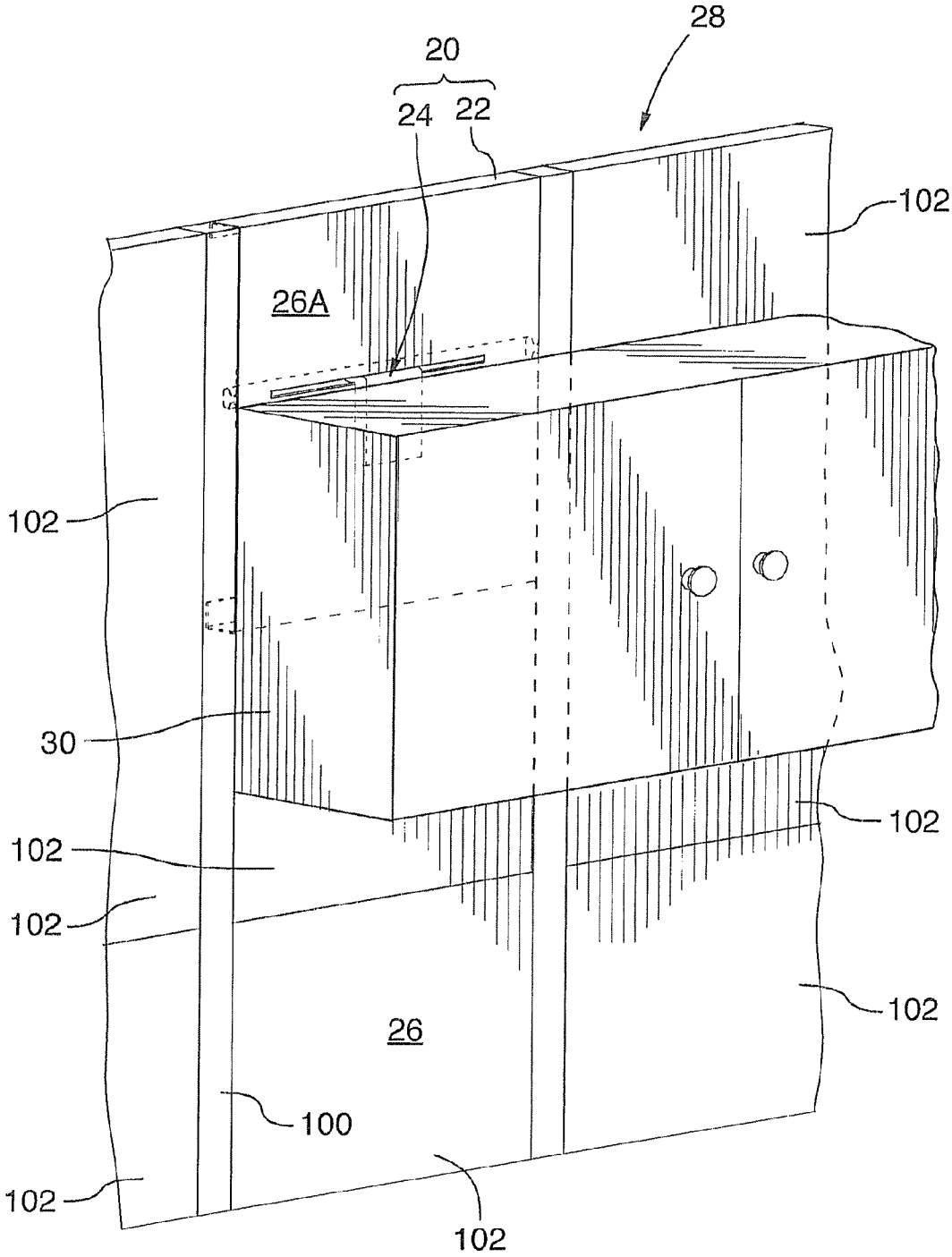
FIG. 1 is an isometric view of a system according to a preferred embodiment of the invention in use suspending a cupboard from a wall surface in an assembly for partitioning or dividing a space, the system being shown partly in phantom outline and the assembly being shown only in part.

A system 20 which forms a preferred embodiment of the present invention comprises a panel 22 and a bracket 24, and is hereinafter described in use, as shown in FIG. 1, wherein it forms part 26A of a wall surface 26 of an assembly 28 for partitioning or dividing a space and for suspending a cupboard 30 from said wall surface 26. But for the system 20, the wall assembly 28 can be of conventional construction, including, as shown, posts 100 from which are suspended panels 102.

Figure 2:
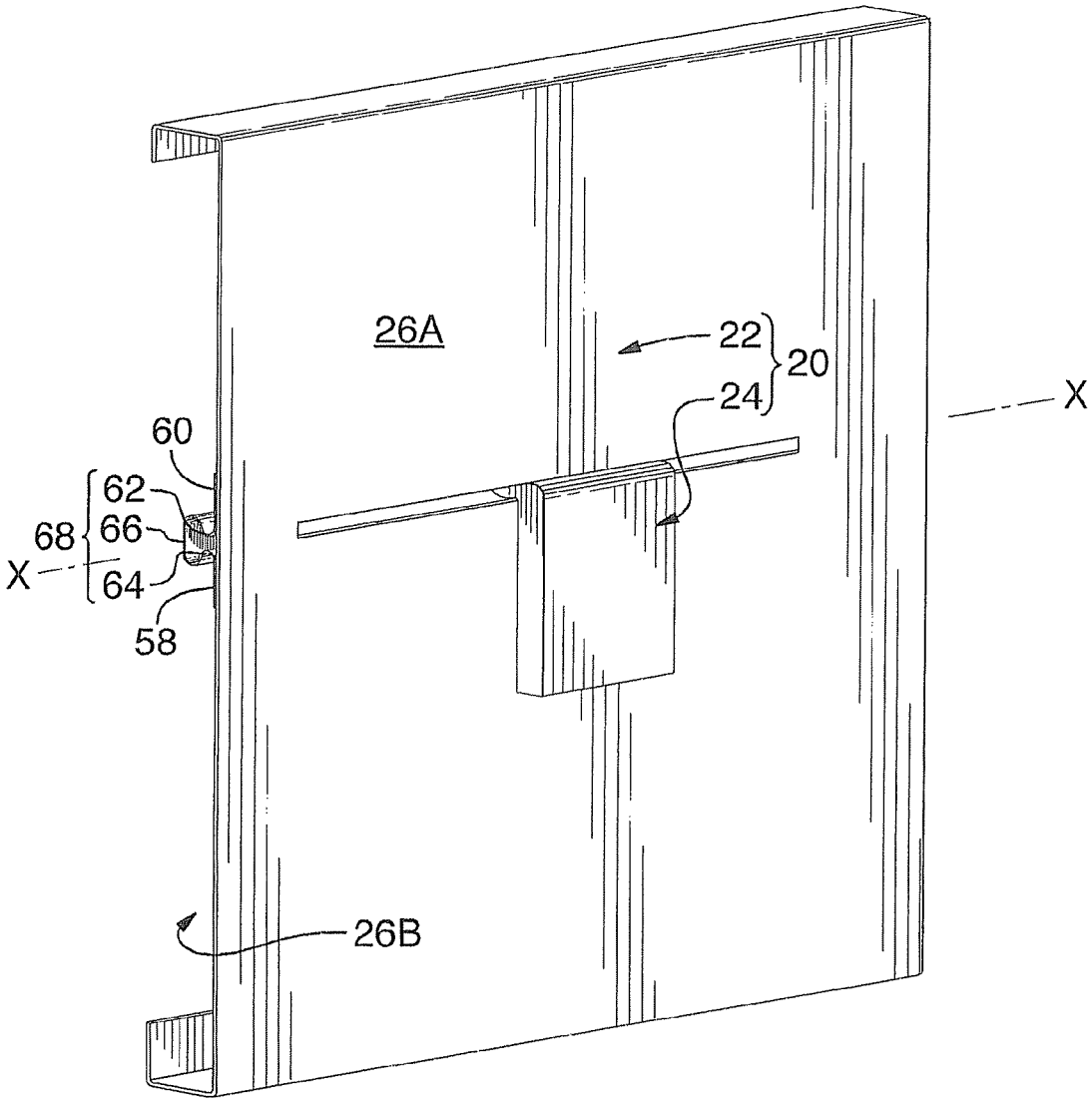
FIG. 2 is an enlarged view of the system of FIG. 1.
Figure 3:
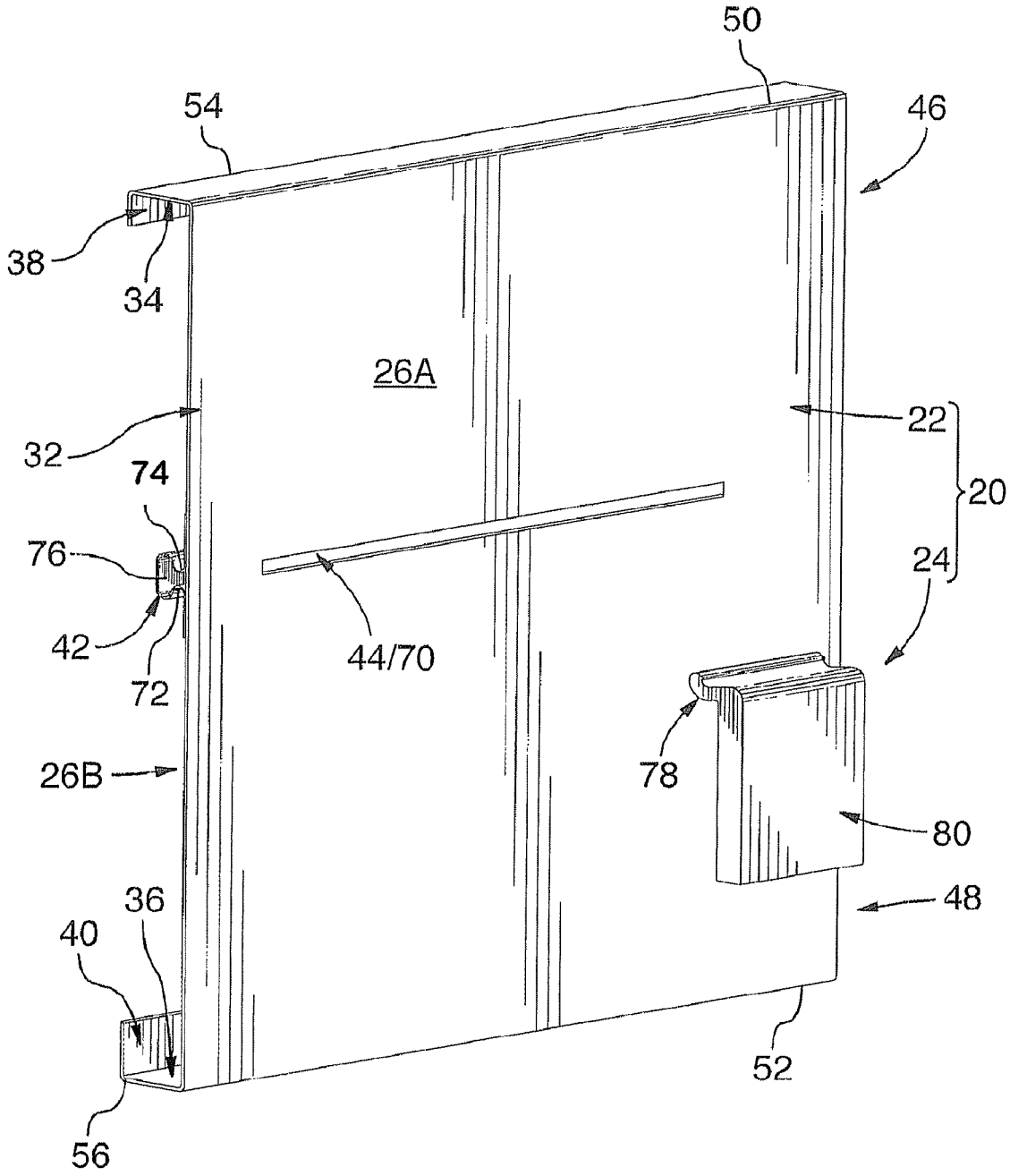
FIG. 3 is an exploded view of the structure of FIG. 2.
Figure 4:
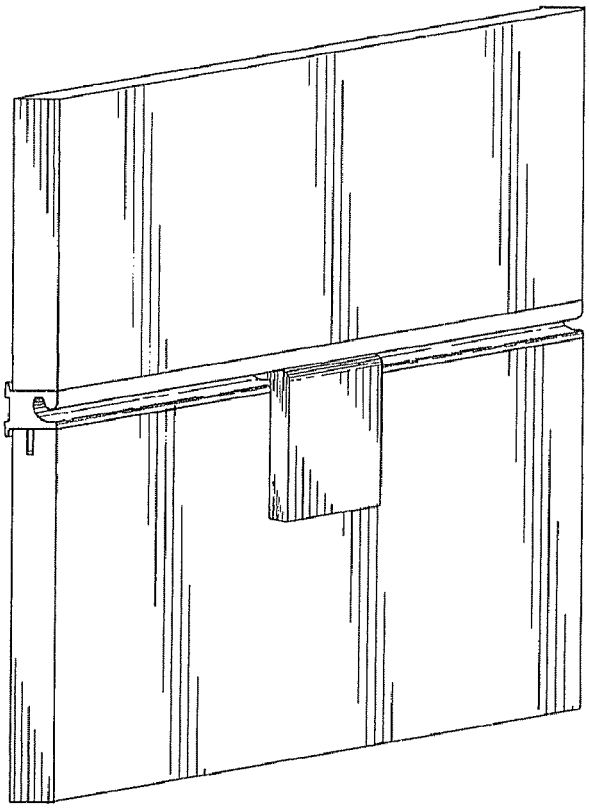
FIG.4 ( PRIOR ART)
FIG. 4 is a view similar to FIG. 2 of a prior art system.
Figure 5:
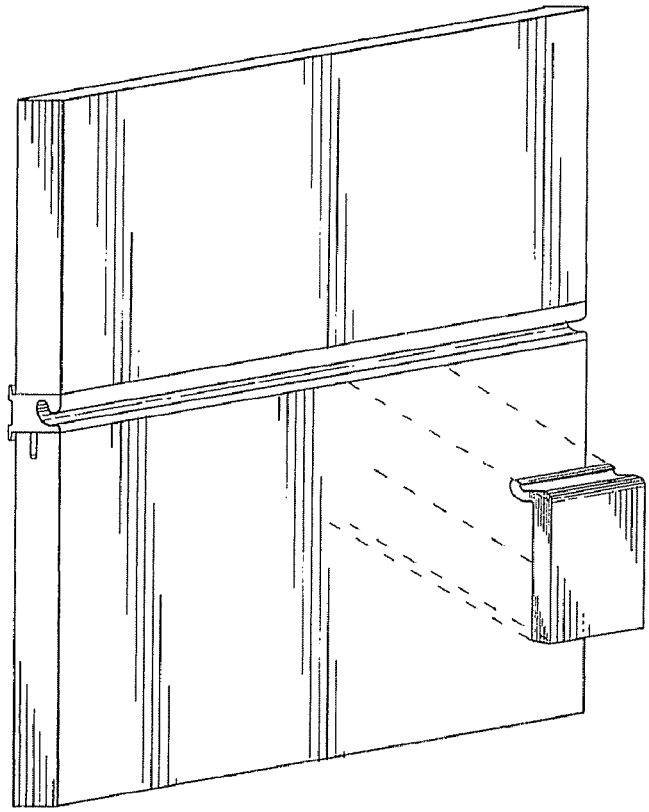
FIG.5 ( PRIOR ART)
FIG. 5 is an exploded view of the structure of FIG. 4.

For greater clarity, the system 20 is shown in isolation in FIG. 2 and exploded in FIG. 3.

The panel 22 will be seen to comprise a sheet 32, upper 34 and lower 36 flanges and a pair of lips 38,40, all formed via a folding process out of a single piece of 1 mm steel, as well as a metal bolster 42. The sheet 32 is generally rectangular, has a front face 26A and a rear face 26B and defines a horizontal slot 44. The front face 26A defines the part wall surface and the slot 44 partially divides the sheet into upper 46 and lower 48 sections. The slot 44 terminates short of the lateral edges of the sheet 32 by about 40 mm on each side.

The upper flange 34 and the lower 36 flange extend rearwardly, from upper 50 and lower 52 edges, respectively, of the sheet 32, to respective rear edges 54,56.

The pair of lips 40,38 extends upwardly and downwardly, respectively, from the rear edges 56,54 of the lower 36 and upper 34 flanges.

The bolster 42 is also 1 mm steel, and includes a pair of planar portions 58,60 and a bridge portion 68, formed in unitary fashion through a bending/folding process from a single piece of steel.

The pair of planar portions 58,60 consist of upper 60 and lower 58 planar portions and are connected, by spot welding, one to each of the upper 46 and lower 48 sections, in flanking relation to the slot 44 and in abutting, overlying relation to the sheet 32.

The bridge portion 68 extends between the planar portions 60,58 to define, in combination with the metal sheet 32, a horizontal groove 70, and consists of upper 62 and lower 64 curved portions and a channel portion 66. The upper 62 and lower 64 curved portions present, towards one another, spaced-apart convex surfaces 72, 74, the upper curved portion 62 extending from the upper planar portion 60 and the lower curved portion 64 extending from the lower planar portion 58. The channel portion 66 defines a concave surface 76 extending from the upper curved portion 62 to the lower curved portion 64.

Figure 6:
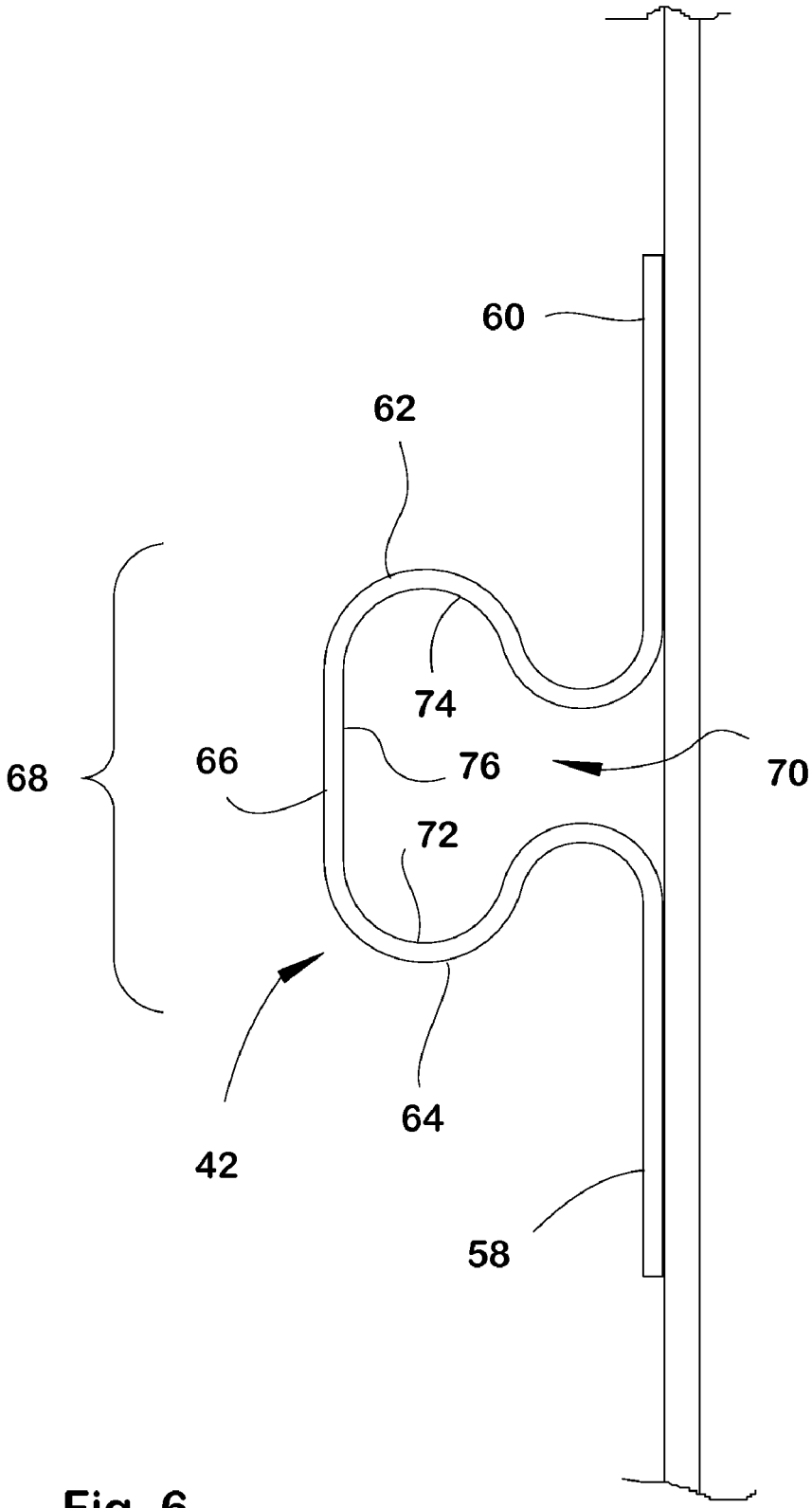
FIG. 6 is an enlarged profile view of a portion of the structure shown in FIGS. 2 and 3.

As evident from the isometric views, the shapes of the bridge portion 68 and planar portions are such that, when the bolster 42 is viewed in profile, i.e. along its longitudinal axis X-X as in FIG. 6, it appears substantially in the form of an omega, with the upper planar portion 60 and the upper curved portion 62 defining a J-shaped portion thereof, the channel portion 66 defining a C-shaped portion thereof and the lower planar portion 58 and the lower curved portion 64 defining an upended J-shaped portion thereof.

The bracket 24 is an aluminum extrusion of a conventional construction having a hook portion 78 and a hanger plate portion 80. The hook portion 78 is radiused and is wrapped around the upper curved portion 62. The hanger portion 80 extends downwardly from the hook portion 78 and abuts the wall surface 26, such that the bracket 24 is thus securely, received, via the horizontal groove 70, by said panel 22, and has secured thereto said cupboard 30, by welding.

While but a single preferred embodiment of the present invention has been herein shown and described, it will be understood that various changes therein may be made without departing from the spirit of the invention.

For example, whereas the system is shown in FIG. 1 in use with a specific type of assembly having uprights posts and suspended panels, the system could be used with other assemblies, with suitable revisions made to the panel as would be routine to persons of ordinary skill in the art.

As well, whereas the sheet and bolster are indicated herein to be formed out of steel, other types of ferrous metals, such as iron, and other materials, such as aluminum and plastics, could be utilized.

Further, whereas the slot is illustrated to extend only partway across the sheet, the slot could extend fully across the sheet, in which case it could be advantageous to construct the bolster out of more robust material. Additionally, whereas the bolster is indicated to be welded, the bolster could be secured by other conventional means, such as adhesive, screws, rivets, etc.

Further, whereas the panel illustrated includes a specific arrangement of flanges and lips, these are not necessary. As well, the flanges and lips could be formed on the bolster, instead of the sheet. In this case, the flanges could extend from the planar portions of the bolster, and the sheet could be coextensive with the planar portions or cover only the area overlying the bridge portion.

Yet further, whereas the illustrated bolster appears in the general form of an omega in profile, other shapes could be utilized, provided commensurate changes were made to the bracket. It also worth noting that the term "bolster" used throughout the specification and claims is used in its broadest meaning, as a structural part designed to provide support.

As well, whereas the cupboard shown is indicated to be secured to the bracket by welding, other conventional securement mechanisms could be utilized, such as screws or bolts.

Finally, but without limitation, whereas the system is shown in use with a cupboard, it will be evident that the system could readily be used with other structures that might be suspended from a wall, such as shelving, table surfaces, etc.

Accordingly, the invention should be understood to be limited only by the claims appended hereto, purposively construed.

The invention claimed is:

1. An improved panel for use with a bracket and which, in use, forms a wall surface as part of an assembly for partitioning or dividing a space, defines a horizontal groove and is adapted to releasably, securely, receive, via the horizontal groove, said bracket, wherein the improvement comprises:

a metal sheet having a front and a rear face, the front face defining said wall surface in use and said sheet defining a horizontal slot in use; and a metal bolster secured to the rear face of said metal sheet to define, in combination with the metal sheet, said horizontal groove, wherein the bolster defines:

upper and lower planar portions abutting the sheet on opposite upper and lower sides of the slot;

upper and lower curved portions presenting, towards one another, spaced-apart convex surfaces, the upper curved portion extending from the upper planar portion and the lower curved portion extending from the lower planar portion; and a channel portion defining a concave surface extending from the upper curved portion to the lower curved portion;

wherein the upper and lower planar portions and the channel portion are formed by bending or folding from a single piece of sheet metal.

2. A panel according to claim 1, wherein the metal is ferrous metal.

3. A panel according to claim 1, wherein, in use, the slot at least partially divides the sheet into upper and lower sections; and the bolster includes a pair of planar portions connected one to each of the upper and lower sections, in flanking relation to the slot; and a bridge portion extending between the planar portions.

4. A panel according to claim 1, wherein, in use, the slot partially divides the sheet into upper and lower sections.

5. A panel according to claim 1, wherein the bolster has a longitudinal axis which is orientated horizontally in use and wherein, when viewed in profile, the bolster appears substantially in the form of an omega.

6. A panel according to claim 1, wherein the bolster has a longitudinal axis which is orientated horizontally in use and wherein, when viewed in profile in use, with the front face presenting to the right of the viewer, the upper planar portion and the upper curved portion define a J-shape;

the channel portion defines a C-shape; and the lower planar portion and the upper curved portion define an upended J-shape.

7. A panel according to claim 1, further comprising an upper flange and a lower flange extending rearwardly, from upper and lower edges, respectively, of the sheet in use, to respective rear edges.

8. A panel according to claim 7, further comprising a pair of lips extending upwardly and downwardly, respectively, from the rear edges of the lower and upper flanges.

9. A system for forming part of a wall surface of an assembly for partitioning or dividing a space and for suspending a cupboard from said wall surface, said system comprising: a panel including a metal sheet and a metal bolster, the metal sheet having a front and a rear face, the front face defining said part of said wall surface in use and said sheet defining a horizontal slot in use, and the metal bolster being secured to the rear face of said metal sheet to define, in combination with the metal sheet, said horizontal groove, wherein the bolster defines: upper and lower planar portions abutting the sheet on opposite upper and lower sides of the slot; upper and lower curved portions presenting, towards one another, spaced-apart convex surfaces, the upper curved portion extending from the upper planar portion and the lower curved portion extending from the lower planar portion; and a channel portion defining a concave surface extending from the upper curved portion to the lower curved portion; and a bracket adapted to be releasably, securely, received, via the horizontal groove, by said panel, and to have secured thereto said cupboard.

10. A system according to claim 9, wherein, in use, the slot at least partially divides the sheet into upper and lower sections; and the bolster includes a pair of planar portions connected one to each of the upper and lower sections, in flanking relation to the slot; and a bridge portion extending between the planar portions.

11. A system according to claim 9, wherein the bolster has a longitudinal axis which is orientated horizontally in use and wherein, when viewed in profile, the bolster appears substantially in the form of an omega.

12. A system according to claim 9, wherein the bolster has a longitudinal axis which is orientated horizontally in use and wherein, when viewed in profile in use, with the front face of the panel presenting to the right of the viewer, the upper planar portion and the upper curved portion define a J-shape;

the channel portion defines a C-shape; and the lower planar portion and the upper curved portion define an upended J-shape.

13. A system according to claim 9, wherein the panel further comprises an upper flange and a lower flange extending rearwardly, from upper and lower edges, respectively, of the sheet in use, to respective rear edges.

14. A system according to claim 13, wherein the panel further comprises a pair of lips extending upwardly and downwardly, respectively, from the rear edges of the lower and upper flanges.

15. A system according to claim 9, wherein the bracket is an aluminum extrusion having, when in use and when releasably, securely, received, via the horizontal groove:

a hook portion wrapped around the upper curved portion; and a hanger plate portion extending downwardly from the hook portion and abutting the wall surface.

16. A system according to claim 9, wherein the bracket has a support position, whereat it is securely received, via the horizontal groove, by said panel, and, from the support position, can be released from the panel by pivoting the lower end of the bracket away from the panel.

* * * * *